US009228351B1

(12) United States Patent
Perry et al.

(10) Patent No.: US 9,228,351 B1
(45) **Date of Patent: *Jan. 5, 2016**

(54) SUPPORT CHAIR FOR BRACING OBJECTS TO BE IMBEDDED IN CONCRETE OR THE LIKE

(71) Applicants: Jack Perry, Silver Spring, MD (US); Greg Ewart, Kapolei, HI (US)

(72) Inventors: Jack Perry, Silver Spring, MD (US); Greg Ewart, Kapolei, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/497,714

(22) Filed: Sep. 26, 2014

Related U.S. Application Data

(63) Continuation of application No. 13/759,622, filed on Feb. 5, 2013, now Pat. No. 8,863,468.

(51) Int. Cl.

| | |
|---|---|
| ***E04C 5/16*** | (2006.01) |
| ***E04C 5/20*** | (2006.01) |
| ***E04C 5/18*** | (2006.01) |

(52) U.S. Cl.
CPC ..... *E04C 5/166* (2013.01); *E04C 5/168* (2013.01); *E04C 5/18* (2013.01); *E04C 5/203* (2013.01)

(58) Field of Classification Search
CPC ..... E04C 5/168; E04C 5/16; E04C 5/206; E04C 5/20
USPC ..... 52/677, 687, 686, 105, 685; D8/354, D8/349, 380
See application file for complete search history.

(56) References Cited

U.S. PATENT DOCUMENTS

| | | | |
|---|---|---|---|
| 1,063,663 | A | 6/1913 | Davis |
| 5,729,949 | A | 3/1998 | Hartzheim |
| 5,791,095 | A | 8/1998 | Sorkin |
| D500,243 | S | 12/2004 | Turek |
| 7,497,059 | B2 | 3/2009 | Bennett |
| 8,322,108 | B2 | 12/2012 | Lee et al. |
| 2005/0005564 | A1 | 1/2005 | Bennett et al. |
| 2006/0032179 | A1 | 2/2006 | Lee et al. |
| 2007/0157542 | A1 | 7/2007 | Peterson, Jr. |
| 2009/0044481 | A1 | 2/2009 | Turek |
| 2012/0247058 | A1 | 10/2012 | Alfonso |

*Primary Examiner* — Brian Glessner
*Assistant Examiner* — Paola Agudelo
(74) *Attorney, Agent, or Firm* — Garcia-Zamor IP Law; Ruy M. Garcia-Zamor

(57) ABSTRACT

A support chair for bracing objects, such as rebar, cable, or the like. The support chair is preferably configured to support rebar at any one of multiple different heights.

17 Claims, 9 Drawing Sheets

SUPPORT CHAIR FOR BRACING OBJECTS TO BE IMBEDDED IN CONCRETE OR THE LIKE

CROSS-REFERENCE TO RELATED APPLICATIONS

This application claims priority to and benefit of the following application: U.S. patent application Ser. No. 13/759,622 filed Feb. 5, 2013, which is hereby incorporated by reference in its entirety as if fully set forth herein.

BACKGROUND

The present invention is generally directed to support chairs for construction and, more specifically, to support chairs that have increased versatility during at least one of manufacturing, shipping, or use.

Typically, a construction project in which concrete is poured into a form may require the use of twenty different supports to position rebar or cable in certain positions prior to the pouring of concrete into the form. Management of the inventory of large number of forms can take a tremendous amount of time and labor. Additionally, most supports are rather blocky and as such are expensive to ship and require a lot of storage space. Additionally, the use of so many different supports slows down the efficiency of placement of supports within a form due to the time needed to select the proper support and limitations on how many supports can be carried by a single worker in a single trip.

It may be advantageous to provide a chair support that: is easier to carry in large numbers, is simpler to ship and transport, avoids the need for so many worker hours to be devoted to placement, reduces the amount of administrative burden created by the need for companies to maintain and monitor inventory, and which reduces the number of supports that need to be kept on hand to complete varied projects.

SUMMARY

Briefly speaking, one embodiment of the present invention is directed to a support chair for bracing objects to be embedded in poured material (such as concrete or the like) including a body having an upper surface defining a plurality of cutout pairs. Each of the plurality of cutout pairs is adapted to support rebar or another object. The plurality of cutout pairs resulting in the support chair being configured to support rebar at any one of at least three different heights as measured from the base (or bottom) of the support chair.

In a separate aspect, the present invention is directed to a method of simplifying inventory of support chairs for use in construction projects. The method including the steps of: providing a first plurality of support chair each having a body with an upper surface defining a plurality of cutout pairs, wherein each of the plurality of cutout pairs is adapted to support rebar, the plurality of cutout pairs resulting in the body being configured to support rebar at any one of at least three different heights as measured from a base of the body; and providing a second plurality of support chair each having a body with an upper surface defining a plurality of cutout pairs, wherein each of the plurality of cutout pairs is adapted to support rebar, the plurality of cutout pairs results in the body being configured to support rebar at any one of at least three different heights as measured from the base of the body; wherein the first and second pluralities of support chairs are each colored differently and of different size to facilitate easy monitoring of inventory of support chairs for construction projects by reducing the number of differently sized support chairs needed and using color coding for quick visual reference.

In a separate aspect, the present invention is directed to a method of manufacturing a support chair for bracing objects to be embedded in poured material. The method includes the step of: providing a body having an upper surface defining a plurality of cutout pairs, wherein each of the plurality of cutout pairs is adapted to support rebar, the plurality of cutout pairs results in the support chair being configured to support rebar at any one of at least three different heights, the body being configured to allow the support chair to be nested with an addition support chair.

In a separate aspect, the present invention is directed to a method of using a support chair for bracing objects to be embedded in poured material. The method including providing a body having an upper surface defining a plurality of cutout pairs, wherein each of the plurality of cutout pairs is adapted to support rebar, the plurality of cutout pairs resulting in the support chair being configured to support rebar at any one of at least three different heights.

In a separate aspect, the present invention is directed to a support chair for bracing objects to be embedded in poured material including a body having an upper surface defining a plurality of cutout pairs. Each of the plurality of cutout pairs is adapted to support rebar. The plurality of cutout pairs resulting in the support chair being configured to support rebar at any one of at least three different heights as measured from the base of the support chair. The body being configured so that multiple support chairs can be nested one within the other for shipping.

In a separate aspect, the present invention is directed to a method of simplifying inventory of support chairs for use in construction projects. The method including the steps of: providing first and second pluralities of support chairs each capable of supporting rebar, or cable or similar material, at one of multiple heights, wherein the first and second pluralities of support chairs are each colored differently and of different size to facilitate easy monitoring of inventory of support chairs for construction projects by reducing the number of differently sized support chairs needed and using color coding for quick visual reference.

In a separate aspect, the present invention is directed to a support chair for bracing objects to be embedded in poured material including a body having an upper surface defining a plurality of cutout pairs. Each of the plurality of cutout pairs is adapted to support rebar. The plurality of cutout pairs being configured so that the support chair can preferably support rebar at any one of at least three different heights.

In a separate aspect, the present invention is directed to a support chair for bracing objects including a body configured to support rebar (or any other object) at any one of at least three different heights.

BRIEF DESCRIPTION OF THE SEVERAL VIEWS OF THE DRAWINGS

The foregoing summary, as well as the following detailed description of the preferred embodiments of the present invention will be better understood when read in conjunction with the appended drawings. For purposes of illustrating the invention, there are shown in the drawings, embodiments which are presently preferred. It is understood, however, that the invention is not limited to the precise arrangements and instrumentalities shown. In the drawings:

FIGS. 3A through 3C show the support chairs having only three different heights for supporting rebar 42, those of ordinary skill in the art will appreciate from this disclosure that the number of cutout pairs 32A, 32B, 32C, 32D can be adjusted to provide even more than three height positions for supporting rebar 42 without departing from the scope of the present invention;

FIGS. 4A through 4C show the support chairs 46 having only three different heights for supporting rebar, those of ordinary skill in the art will appreciate from this disclosure that the number of cutout pairs 32A, 32B, 32C, 32D can be adjusted to provide even more than three height positions for supporting rebar 42 without departing from the scope of the present invention; taken together, FIGS. 3A-3C and FIGS. 4A-4C show how by using just a few of the support chairs 44, 46 of the present invention one is able to support rebar 42 at many different heights; this allows the support chairs 20 of the present invention to be used to greatly simplify inventory for companies or people using support chairs as part of their concrete works or other activities; more specifically, three or four different size support chairs can be color-coded and each kept in stock so that perhaps three to four different sizes of support chairs 20 can accommodate rebar, or the like, during concrete pouring operations at all the needed heights; this allows for easier selection and placement of support shares and due to the reduction of sizes of support chairs which must be maintained in inventory greatly reduces the inventory burden on companies specializing in poured concrete and the like;

DETAILED DESCRIPTION OF THE PREFERRED EMBODIMENT

Figure 1:
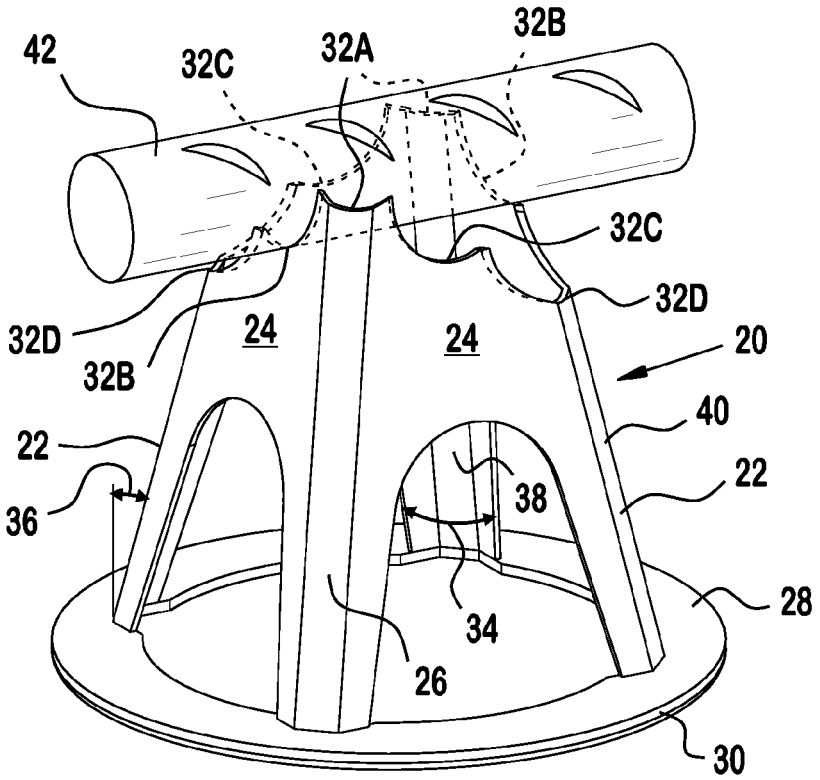
FIG. 1 is a perspective view of a first preferred embodiment of the support chair 20 of the present invention; the support chair 20 preferably includes four major lateral surfaces 24 separated by beveled faces 26 therebetween; each of the major lateral surfaces 24 preferably forms a portion of two legs 22 of the body; the body preferably includes a base 28 that is annular with a generally planar bottom surface; a piece of rebar 42 is shown positioned in one of the plurality of pairs of cutouts 32A, 32B, 32C, 32D formed by the upper surface of the body; while one preferred configuration is shown herein, those of ordinary skill in the art will appreciate from this disclosure that the support chair (also referred to as a chair) 20, 44 may have any configuration without departing from the scope of the present invention.

Certain terminology is used in the following description for convenience only and is not limiting. The words "right," "left," "upper," and "lower" designate directions in the drawings to which reference is made. The words "inwardly" and "outwardly" refer to directions toward and away from, respectively, the geometric center of the support chair 20 and designated parts thereof. The term "rebar" or the like, as used in the claims and in corresponding portions of the specification, is understood to mean "rebar, cables, or any other material to supported within a form". The terminology includes the words above specifically mentioned, derivatives thereof, and words of similar import. Additionally, the words "a" and "one" are defined as including one or more of the referenced item unless specifically stated otherwise.

Referring to FIGS. 1-13, wherein like numerals indicate like elements throughout, preferred embodiments of a support chair 20 that is configured to support rebar, cable, or any other suitable structure within a form or mold prior to pouring concrete or other suitable material thereover is shown. The support chair 20 is preferably capable of supporting rebar 42 at multiple different heights while the base 28 of the support chair 20 is in a constant position within the form 50.

The support chair 20, and its component parts are preferably formed from a durable, lightweight, high-strength material such as polymer or carbon fiber polymer. However, those of ordinary skill in the art will appreciate from this disclosure that the support chair 20 and its various components can be formed from any suitable materials without departing from the scope of the present invention.

Figure 2:
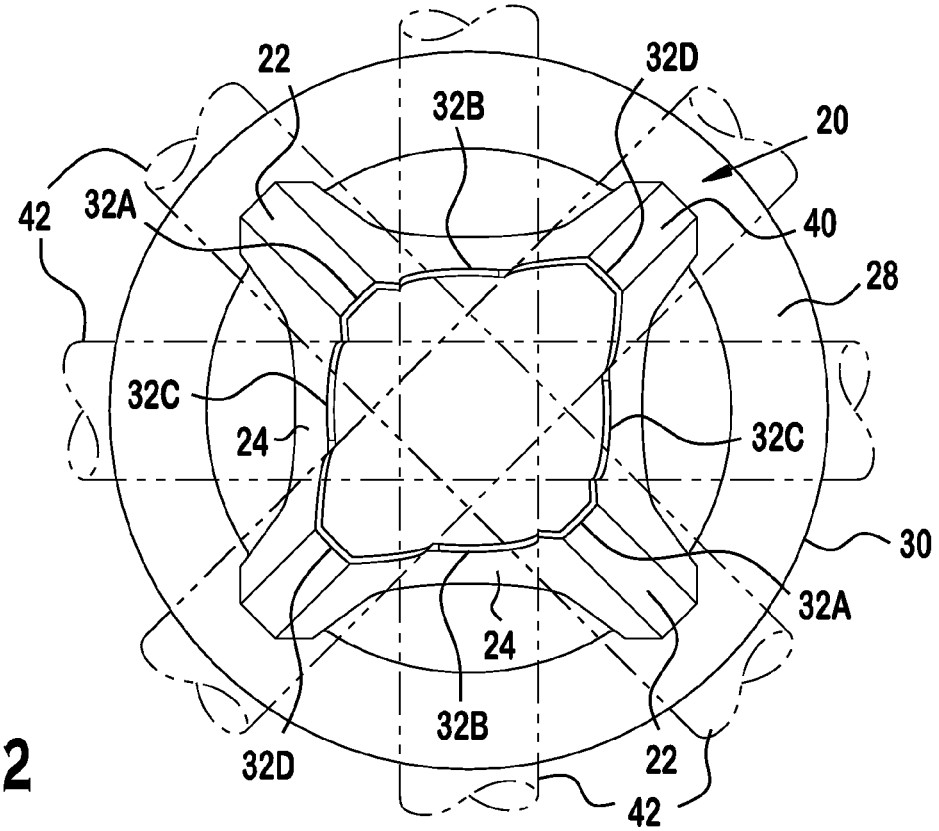
FIG. 2 is a top plan view of the support chair 20 of FIG. 1 illustrating that rebar 42 can preferably be positioned in any one of four orientations relative to the body without altering the position of the body of the support chair 20; the rebar 42 is shown in phantom lines in this Figure; although four preferred orientations of the rebar 42 are shown, based on the position of the cutouts, those of ordinary skill in the art will appreciate from this disclosure that depending on the number and position of cutouts the particular orientations of the rebar 42 can vary (from one to any multiple orientations) without departing from the scope of the present invention.
Figure 3A:
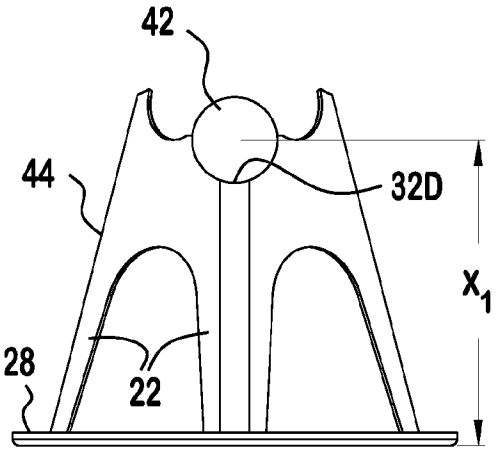
FIG. 3A is a side elevational view of the support chair 20, 44 of FIG. 1 illustrating rebar 42 positioned at a first height relative to the base 28 of the support chair 44; the height of the rebar 42 depends in part on the position of the cutout pair 32A, 32B, 32C, 32D in which the rebar 42 is located; this first height is designated X1; two of the four beveled faces form part of the cutout pair that supports the rebar in this lowest position having a height of X1.
Figure 3B:
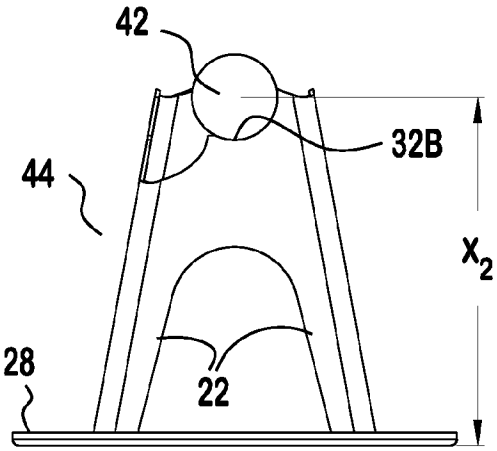
FIG. 3B is a side elevational view of the support chair 20, 44 of FIG. 1 illustrating rebar 42 positioned at a second height relative to the base of the support chair; the height of the rebar depends on the position of the cutout pair 32A, 32B, 32C, 32D in which the rebar 42 is located; this second height is designated X2.
Figure 3C:
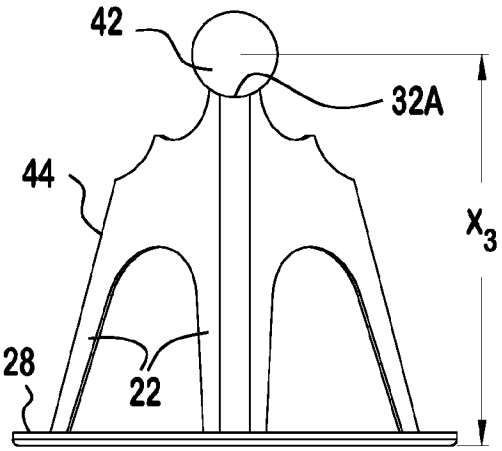
FIG. 3C is a side elevational view of the support chair 44 of FIG. 1 illustrating rebar 42 positioned at a third height relative to the base 28 of the support chair 20; this third height is designated X3; the remaining two of the four beveled faces form part of the cutout pair that supports the rebar in this highest position having a height of X3; although
Figure 8:
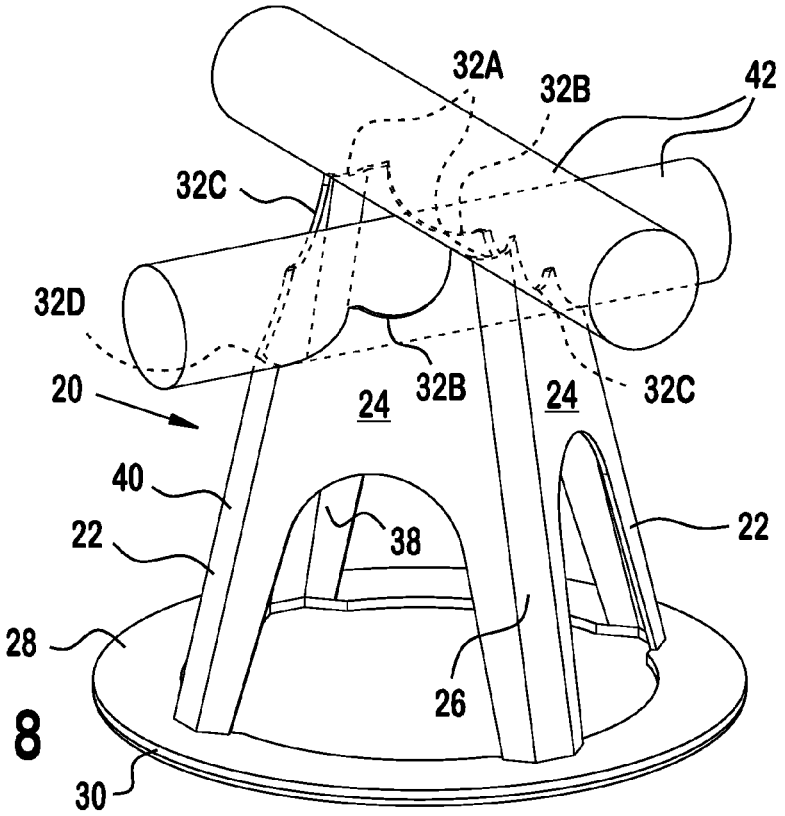
FIG. 8 is a perspective view of the support chair 20, 44 of FIG. 1 illustrating a single support chair 20 being used to support two separate pieces of rebar 42 thereon; a first section of rebar 42 is positioned through the lowest of the plurality of cutout pairs 32D and a second section of rebar is positioned on the highest of the plurality of cutout pairs 32A; it is preferable, but not necessary, that each of the four major lateral surfaces 24 defines a portion of two separate legs 22 to define an opening therebetween having an arched perimeter along an upper portion thereof.

Referring to FIGS. 1, 2, and 8, a support chair 20 for bracing objects (such as rebar, cable, or the like) to be embedded in poured material (such as concrete or the like) is shown. The support chair 20 has a body having an upper surface defining a plurality of cutout pairs 32A, 32B, 32C, 32D. Each of the plurality of cutout pairs 32A, 32B, 32C, 32D is preferably adapted to support rebar 42 or the like. The plurality of cutout pairs 32A, 32B, 32C, 32D preferably result in the support chair being configured to hold rebar 42 at any one of three different heights relative to the base 28 of the support chair 20 (as shown in FIGS. 3A through 3C). By increasing the number of heights at which rebar can be held by a single support chair 20 the number of support chairs 20 which need to be maintained in inventory for construction projects is greatly reduced. This also simplifies labor when needing to carry support chairs 20 to different locations within a form 50 to support rebar 42 at different heights relative to the form surface.

Referring specifically to FIG. 2, it is preferred, but not necessary, that the support chair 20 is configured to support rebar 42 in any one of at least four directions without changing the orientation or position of the body of the support chair 20. Multiple pieces of rebar 42 are shown in phantom lines demonstrating the multiple positional configurations that can be used in conjunction with one support chair 20.

Figure 10:
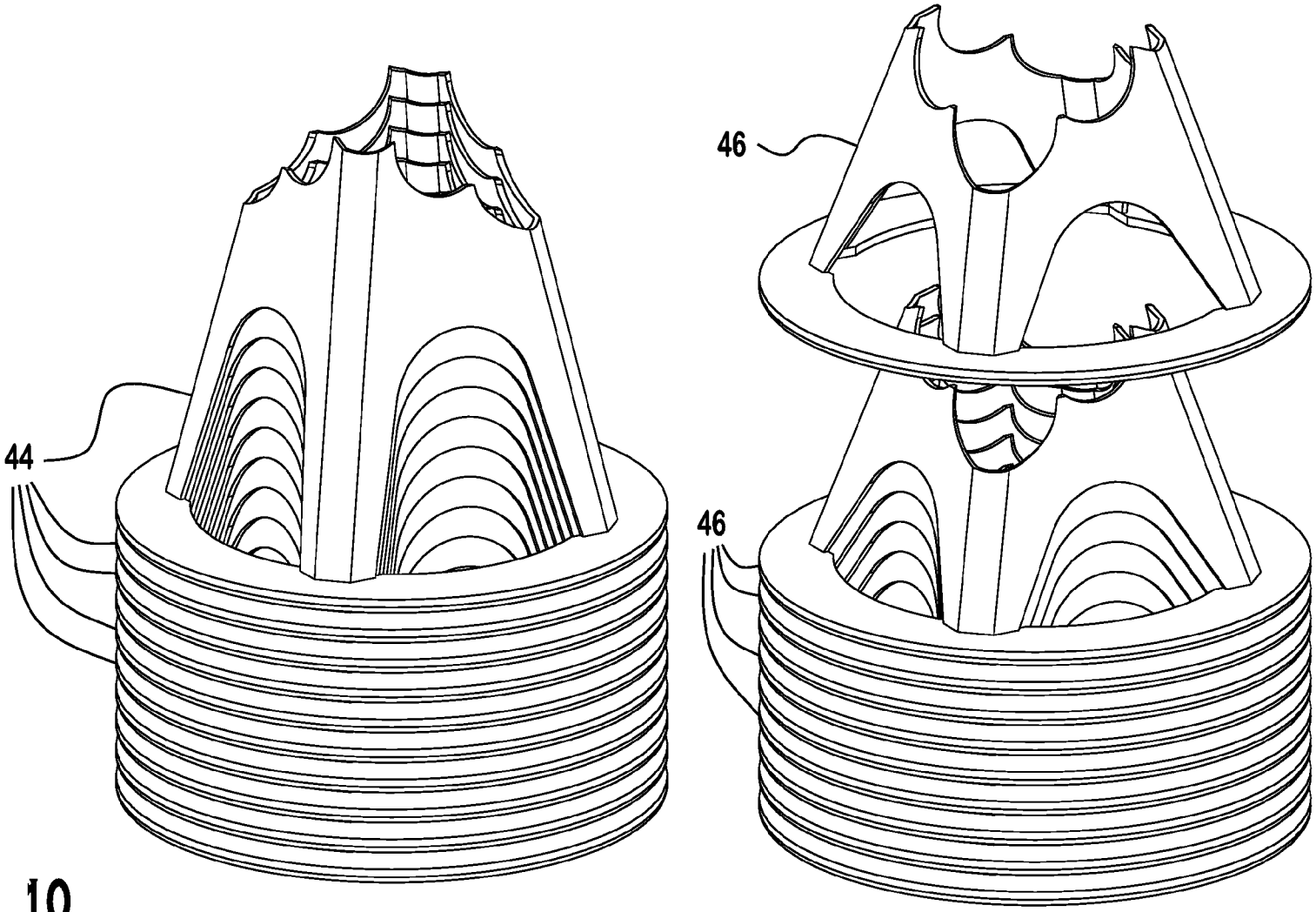
FIG. 10 is a perspective view of multiple support chairs 44, 46 showing how the preferred generally inwardly angled major lateral surfaces 24 allow the support chairs 44, 46 to be nested one within the other; it is also preferred that the support chairs 44, 46 are formed of a high-strength polymer or similar material; due to the light weight of the support chairs 44, 46 and the ability to nest the support chairs 44, 46 one within the other, shipping and transportation of the support chairs is more efficient than that previously possible.
Figure 11:
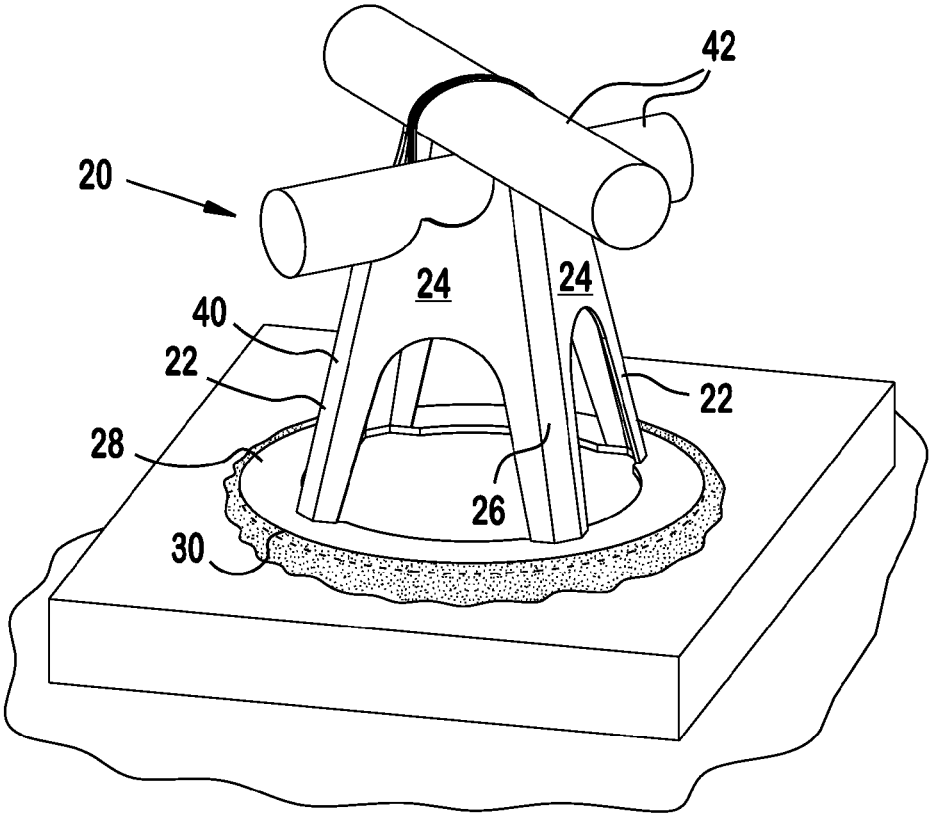
FIG. 11 illustrates the support chair 20 of FIG. 1 secured to a surface of the adhesive; two sections of rebar 42 are also tied together on the support chair 20.

Referring to FIGS. 1 and 11, the support chair 20 body preferably includes four major lateral surfaces 24. It is preferred that the four major lateral surfaces 24 are angled generally inwardly to allow the support chair 20 to be nested within additional support chair (as shown in FIG. 10). Beveled faces 26 are preferably located between each of the major lateral surfaces 24. The multiple bends in the lateral sides of the support chair body created by the beveled faces 26 and the major lateral surfaces 24 results in increasing the strength of the support chairs 20 and ability to withstand a vertical load. However those of ordinary skill in the art will appreciate that any particular design of the support chair can be used without departing from the scope of the present invention.

The preferred nesting of the support chairs 20 greatly facilitates shipping and storage of the support chairs 20. This nesting also greatly facilitates the carrying of multiple support chairs 20 by a worker who is positioning the support chairs 20 within a form.

As mentioned above, it is preferred, but not necessary, that a beveled face 26 is located between each of the four major lateral surfaces 24. Referring again to FIG. 1, it is preferable that each of the four major lateral surfaces 24 define a portion of two separate legs 22 to define an opening therebetween which has an arched perimeter along an upper portion of the opening. That is, the perimeter of the opening that is preferably defined within each of the four major lateral surfaces 24 is preferably arched along a portion of the perimeter that is generally opposite from the base 28 of the support chair 20.

Figure 4A:
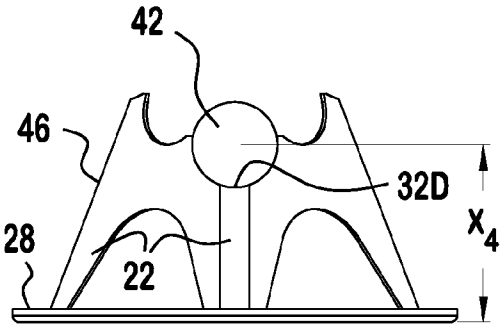
FIG. 4A is a side elevational view of a second embodiment of the support chair 46 of the present invention; this support chair has a different overall height than that shown in FIGS. 3A-3C and illustrates rebar positioned at a fourth height relative to the base 28 of the support chair 46; the height of the rebar 42 depends in part on the position of the cutout pair 32A, 32B, 32C, 32D in which the rebar is located; this fourth height is designated X4; two of the four beveled faces form part of the cutout pair that supports the rebar 42 in this lowest position having a height of X4.
Figure 4B:
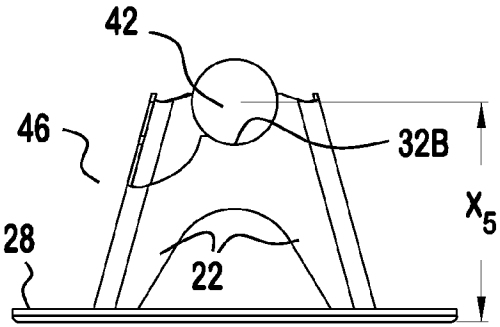
FIG. 4B is a side elevational view of the support chair 46 of FIG. 4A illustrating rebar 42 positioned at a fifth height relative to the base 28 of the support chair 46; the height of the rebar 42 depends on the position of the cutout pair 32A, 32B, 32C, 32D in which the rebar is located; this fifth height is designated X5.
Figure 4C:
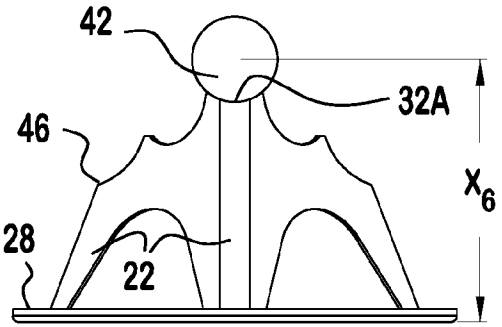
FIG. 4C is a side elevational view of the support chair 46 of FIG. 4A illustrating rebar 42 positioned at a sixth height relative to the base 28 of the support chair 46; this sixth height is designated X6; the remaining two of the four beveled faces 26 form part of the cutout pair that supports the rebar 42 in this highest position having a height of X6; although
Figure 6:
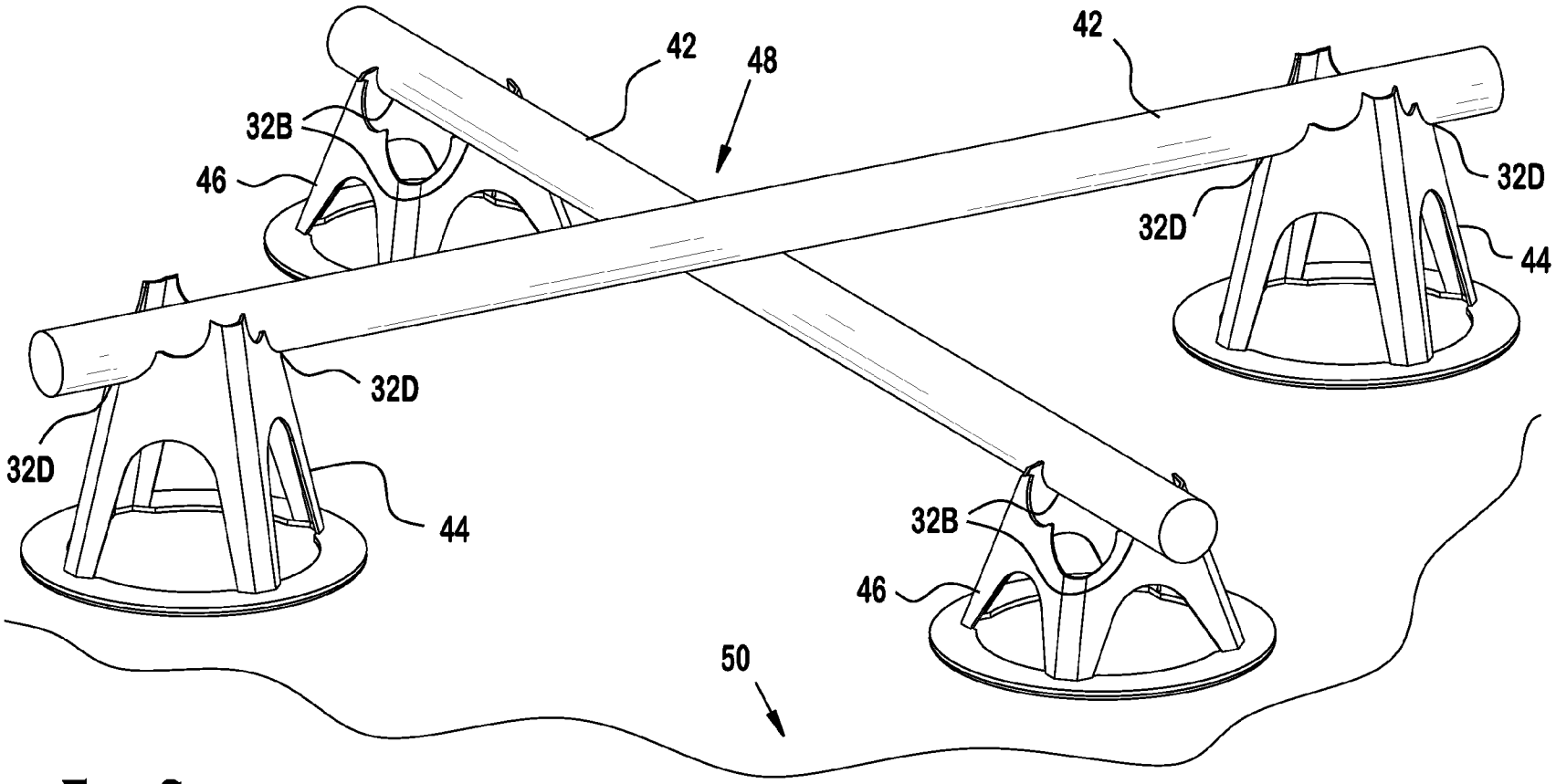
FIG. 6 is a perspective view of four support chairs 44,46 of two different sizes being used to support intersecting 48 pieces of rebar 42; a pair of shorter support chairs 46 is supporting the lower section of rebar 42 and a pair of larger support chairs 44 is supporting the upper section of rebar 42; this illustrates how various size support chairs 44, 46 may possibly be used to support intersecting 48 pieces of rebar 42 in position for tying.

Referring to FIGS. 2 and 6, it is preferred that the support chair body has a base 28 that is formed by a generally annular shape and that the base 28 also has a generally planar bottom surface (as shown in FIGS. 4A-4C). The generally flat bottom surface facilitates the distribution of weight along a greater area.

Referring to FIG. 1, it is preferred that a first angle 36, as measured between the beveled face 26 and an axis oriented perpendicularly to the generally planar bottom surface of the base 28, is between approximately ten degrees and approximately thirty degrees. It is more preferred that the first angle 36 is generally between approximately fifteen degrees and approximately twenty-five degrees. It is more preferred still that the first angle 36 is between approximately nineteen degrees and approximately twenty-three degrees. It is further preferred that the first angle 36 is approximately twenty-one degrees. Those of ordinary skill in the art will appreciate from this disclosure that the first angle 36 can be varied without departing from the scope of the present invention.

Referring to FIGS. 3A and 4A, it is preferred that two of the beveled faces 26 form a portion of the lowest one of the plurality of cutout pairs 32D. it is also preferred that another two of the beveled faces 26 form a portion of the highest one of the plurality of cutout pairs 32A, as measured from the base 28 of the body.

Referring to FIG. 2, multiple possible orientations of rebar 42 are shown in phantom lines. While it is preferred that rebar 42 can be positioned in any one of four positions on top of the support chair 20 without needing to change the orientation of the support chair 20, those of ordinary skill in the art will appreciate from this disclosure that the number of orientations in which rebar 42 can be placed on the support chair 20 can vary without departing from the scope of the present invention.

Referring again to FIG. 1, each of the plurality of cutout pairs 32A, 32B, 32C, 32D is preferably formed by an arcuate section that is made along the upper surface of the support chair body. The preferably crescent and/or arcuate shape of the cutouts is designed to secure material in position prior to tying. For example, the uppermost cutout 32A is formed by an arcuate shape in both of the adjacent major lateral surfaces 24 and by the shape of the top of the beveled face 26. Between at least some of the cutouts 32A, 32B, 32C, 32D is a somewhat outwardly pointed section as shown to the right of cutout 32C. This slightly outwardly pointed section facilitates the positioning of rebar 42 and preferably provides some resistance to the rebar 42 moving rightwardly out of the cutout 32C. The second angle 34 between the inner surface 38 of adjacent major lateral surfaces 24 is preferably between approximately eighty degrees and approximately one hundred-fifteen degrees. More preferably still, the second angle 34 is preferably between approximately eighty-five degrees and approximately ninety-five degrees.

The inwardly angled major lateral surfaces 24 preferably facilitate the nesting of the support chairs as shown in FIG. 10. It is preferable that the outer surface 40 of the support chairs 20 is generally smooth to facilitate nesting. The nesting of support chairs greatly facilitates the transportation of numerous support chairs under all circumstances. For example, shipping is greatly simplified due to the nesting and so is use on the job site. While working on a job site a person can carry a greater number of support chairs 20 due to their light weight and easily stackable configuration.

Referring to FIGS. 3A-3C, a large support chair 44 is shown. Referring to FIGS. 4A-4C, a relatively smaller support chair 46 is shown. Although only two different sizes of support chair 20 are shown, those of ordinary skill in the art will appreciate from this disclosure that the support chair 20 can have any size without departing from the scope of the present invention. The preferable three different heights that the large support chair 44 can support rebar 42 at are identified as X1, X2, and X3, respectively. The preferable three different heights that the small support chair 46 can support rebar 42 at are identified as X4, X5, and X6, respectively. It is preferred, but not necessary, that there are three different size support chairs 20 as follows: (1) a first chair having support heights of approximately two inches, two and a half inches, and three inches; (2) a second chair having support heights of approximately three and a half inches, four inches, and four and a half inches; and (3) a third chair having support heights of approximately five inches, five and a half inches, and six inches. As described above, any number of different support chairs having any desired support heights can be used without departing from the scope of the present invention.

Figure 5:
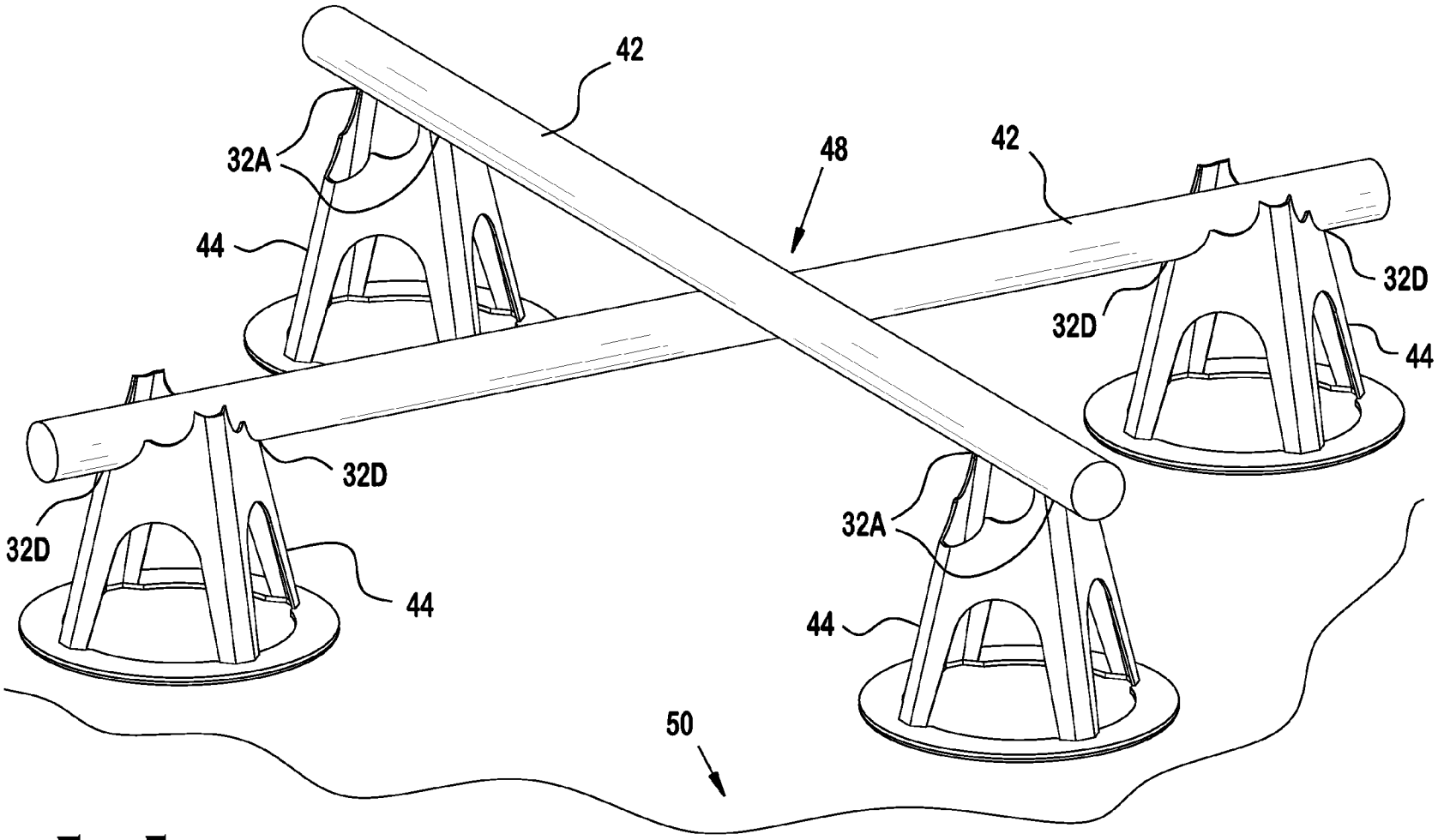
FIG. 5 is a perspective view of four support chairs 44 of the type shown in FIG. 1 being used to support intersecting 48 sections of rebar 42; the lower section of rebar 42 is positioned in the lowest of cutout pairs 32D in of the support chairs 44; the upper section of rebar 42 is supported in the second from the top cutout pair 32B; as such, it is preferably possible for a single size support chair 44 to position two pieces of rebar 42 so that they are ready to tie together.

Referring to FIG. 5, the ability of multiple support chairs 20, 44 to support intersecting rebar 42 is shown. In this example, all of the support chairs 44 are of the larger variety. The generally horizontal rebar section 42 is supported by the lowest cutout pair 32D in two spaced apart support chairs 44. In this case, the lower rebar 42 is supported at the lowest cutout pair height available by the support chair 44. The somewhat more vertical rebar section 42 is also supported by support chairs 44 but is positioned on the first, highest cutout pair 32A in each of two opposing support chairs 20. This results in the two rebar pieces 42 forming an intersection 48 at which the rebar 42 can be tied or otherwise secured. In this example, all of the support chairs 44 are positioned on a form base 50.

Referring to FIG. 6, the ability of multiple support chairs 44, 46 having different sizes to support intersecting 48 rebar 42 is shown. The somewhat lateral section of rebar 42 is supported by larger support chairs 44. The rebar 42 is preferably located in the fourth, lowest cutout pairs 32D of each of the support chairs 44. The somewhat vertical section of rebar 42 is preferably positioned in the second highest cutout pairs 32B in each of at least two smaller support chairs 46. Not only do the support chairs 20 of the present invention increase the versatility with which rebar can be positioned with a minimum of differently sized support chairs, but by using support chairs 20 of different sizes even more flexibility is provided during construction projects.

Figure 7:
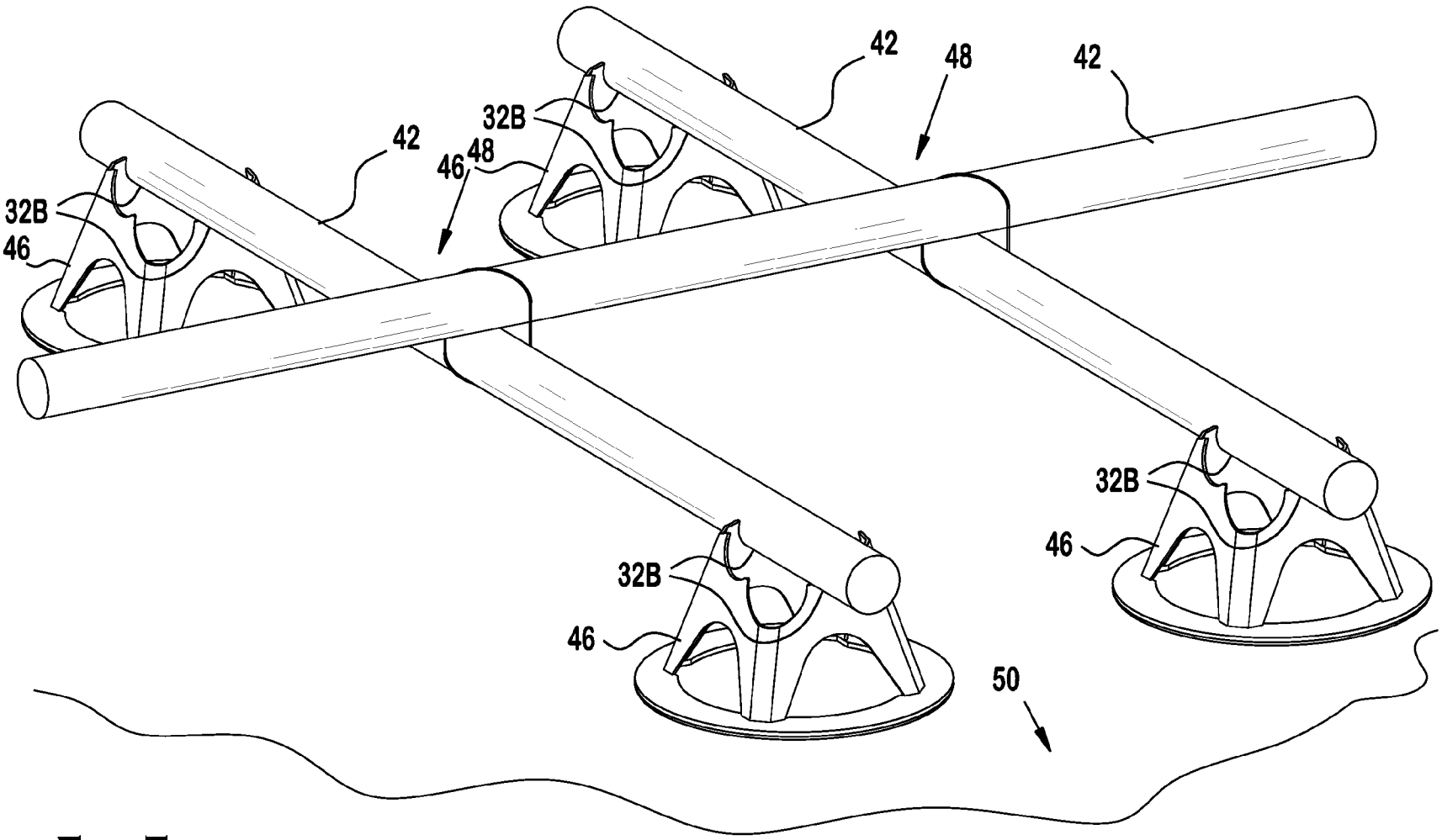
FIG. 7 is a perspective view of four identically sized support chairs 46 used to support sections of rebar 42 in a generally parallel fashion; this allows a third piece of rebar 42 to be laid thereover and then tied in place.

Referring to FIG. 7, multiple support chairs 20, 46 can be used to support multiple rebar sections 42 in a generally parallel fashion to allow additional rebar 42 to be positioned thereover. This facilitates the tying of the overlying rebar at points of intersection 48 with the lower rebar 42. Referring to FIG. 8, a single support chair 20 can be used to support multiple pieces of rebar 42. For example, a lower piece of rebar 42 can be positioned in the fourth, lowest cutout pair 32D and an overlying piece of rebar 42 can be positioned in the first, highest cutout pair 32A. This may allow for the tying of the rebar sections at the intersection point 48 located above the support chair 20. The ability of multiple pieces of rebar 42 to be supported by a single support chair 20 may depend on the size of the support chair 20 and the diameter of the rebar 42. While it is preferred that a single support chair 20 can support multiple pieces of rebar 42, those of ordinary skill in the art will appreciate that it is not required that a support chair 20 support multiple pieces of rebar 42 to be within the scope of the present invention.

Figure 9:
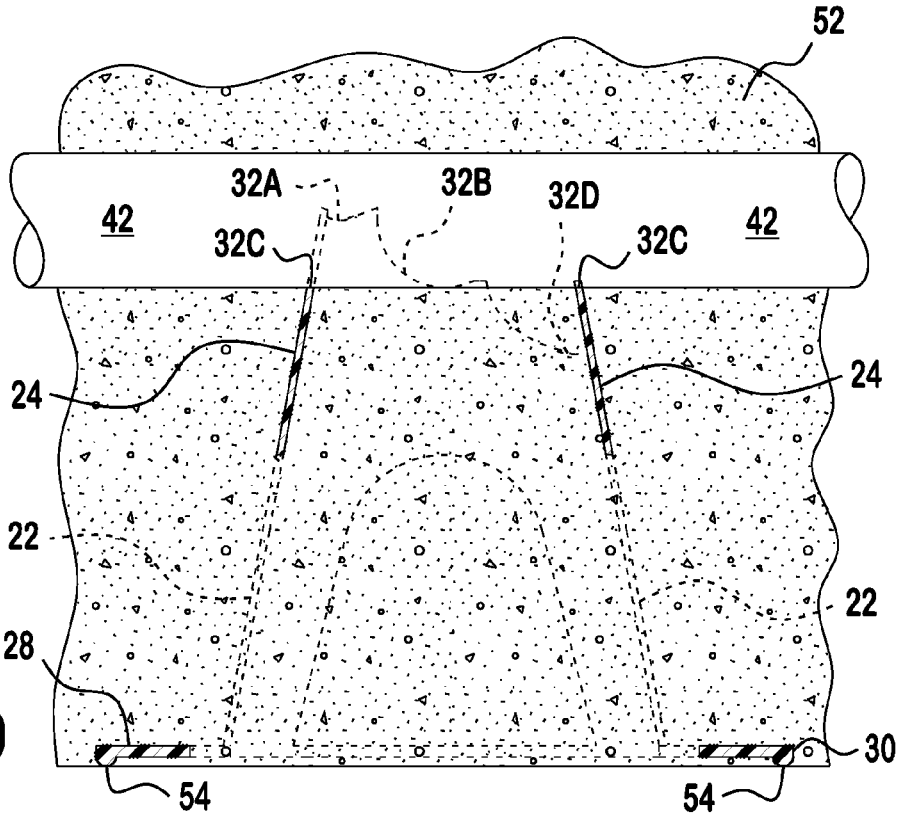
FIG. 9 is a side elevation view of the support chair 20 of FIG. 1 with a section of rebar 421 thereon and with material (such as concrete 52 or the like) poured thereover; it is preferred, but not necessary, that the poured material 52 is concrete; however, those of ordinary skill in the art will appreciate that any suitable poured material may be used without departing from the scope of the present invention.
Figure 12:
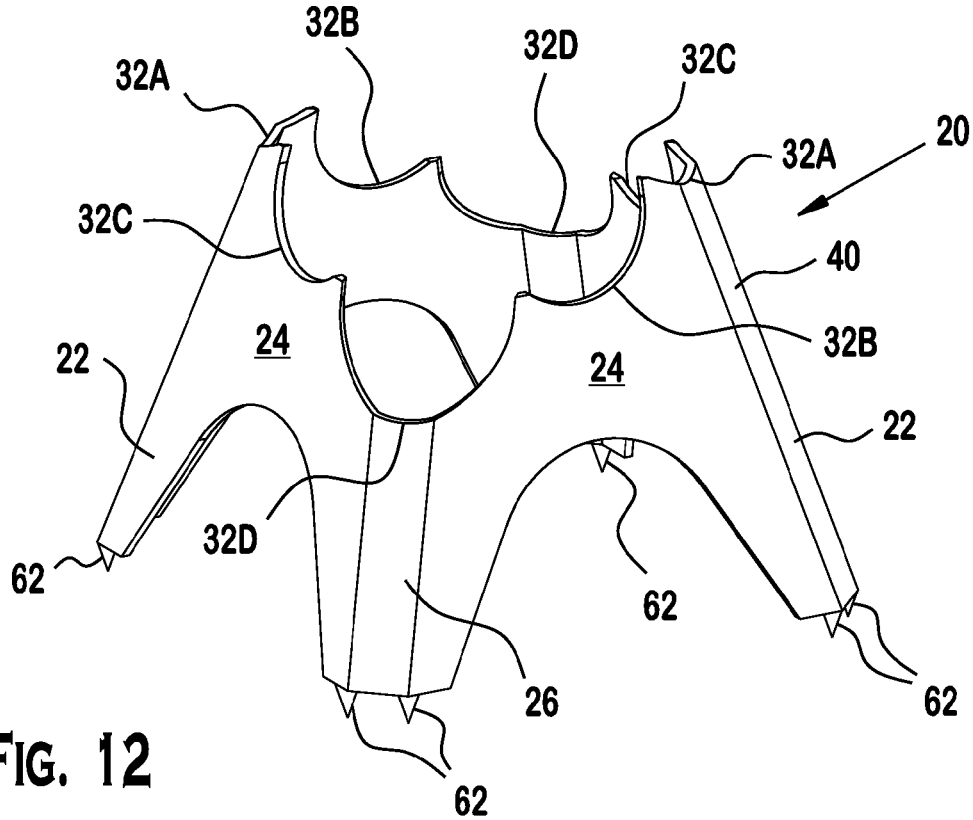
FIG. 12 is a perspective view of a second embodiment of the support chair 20 of the present invention; it is preferred that the base of the support chair is formed by four legs 22 that extend generally downwardly; it is preferred, but not necessary, that small spikes 62 are positioned on the bottom of the legs to minimize contact between this embodiment of the support chair and the bottom of the form 50 or other contacting surface.

Referring to FIG. 9, a lip 54 may be positioned along the edge 30 of the base 28 in some circumstances. FIG. 9 shows the support chair 20 and the associated rebar 42 embedded in concrete 52. Referring to FIG. 11, the support chair 20 may also be secured to a form or other surface via adhesive. Referring to FIG. 12, the base of the support chair 20 may be formed by spikes 62 that are intended to minimize the contact surface between the support chair 20 and any underlying surface. Although a single spike 62 is shown proximate the bottom of each leg, two or more spikes 62 can be positioned proximate to each support leg without departing from the scope of the present invention.

Figure 13:
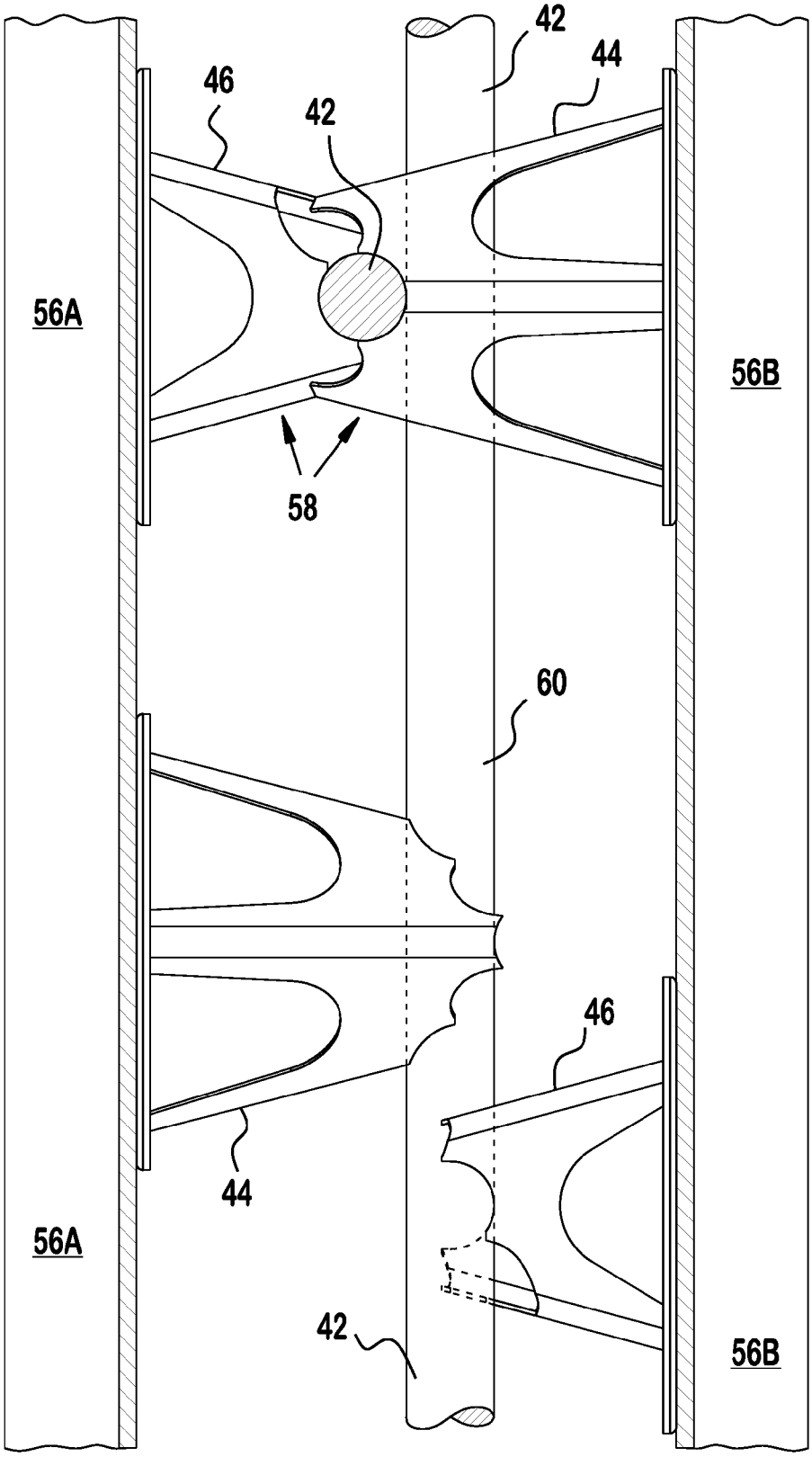
FIG. 13 is a side elevational view illustrating support chairs 44, 46 of different heights being used to secure rebar 42 in the vertical and horizontal positions within first and second horizontal forms 56A, 56B.

FIG. 13 illustrates the use of the support chairs 20 in first and second vertical forms 56A, 56B. In the upper portion of FIG. 13, a large support chair 44 operates in conjunction with the smaller support chair 46 to form a cooperative pair 58 to secure rebar 42 in a generally horizontal position. Similarly, in the bottom of FIG. 13, support chairs 44, 46 are shown in a configuration that facilitates positioning rebar 42 in a generally vertical 60 orientation.

Preferred methods of manufacturing and/or using a support chair 20 or managing inventory thereof according to the present invention are described below. Those of ordinary skill in the art will appreciate from this disclosure that generally similar steps and generally similar structural components of the support chair 20 described below should: generally have similar structure, general include similar alternate constructions, and generally operate in a similar manner as that described above, unless stated otherwise. The steps of the method of the present invention can be performed in any order, interchanged with other steps, or omitted, without departing from the scope of the present invention.

One preferred method of simplifying inventory of support chairs for use in construction projects according to the present invention includes: providing a first plurality of support chairs 44 each having a body with an upper surface defining a plurality of cutout pairs 32A, 32B, 32C, 32D. Each of the plurality of cutout pairs 32A, 32B, 32C, 32D is preferably adapted to support rebar 42. The plurality of cutout pairs 32A, 32B, 32C, 32D results in the body being preferably configured to support rebar 42 at any one of at least three different heights as measured from the base 28 of the body. The method also includes providing a second plurality of support chairs 46 each having a body with an upper surface defining a plurality of cutout pairs 32A, 32B, 32C, 32D, wherein each of the plurality of cutout pairs 32A, 32B, 32C, 32D is adapted to support rebar. The plurality of cutout pairs 32A, 32B, 32C, 32D preferably results in the body being configured to support rebar at any one of at least three different heights. The first and second pluralities of support chairs 44, 46 are preferably each colored differently and of different size to facilitate easy monitoring of inventory of support chairs 44, 46 for construction projects by reducing the number of differently sized support chairs needed and using color coding for quick visual reference. For example, in a typical construction project it may be necessary to maintain an inventory of 18 different support chairs. This can be a full-time job for a single person and can also slow down the construction process due to time spent selecting the proper support chairs for different locations in a form. The support chairs 20 of the present invention used in a similar construction scenario would reduce the number of support chairs needed to six which is much more manageable. Due to the smaller number of support chairs required it is also possible to separately color each of the differently sized support chairs to make identification easier and more efficient. Similarly, the maintenance of inventory of the support chairs 20 is greatly simplified and it is no longer necessary to devote one person's full-time efforts to the task.

The method may include providing a third (or more) plurality of support chairs having a body with an upper surface defining a plurality of cutout pairs. Each of the plurality of cutout pairs is adapted to support rebar. The plurality of cutout pairs 32A, 32B, 32C, 32D preferably results in the body being configured to support rebar 42 at any one of at least three different heights as measured from the base 28 of the body. It is preferred that the first, second, and third support chairs are each colored differently and of different size to facilitate easy monitoring of inventory of support chairs for construction projects by reducing the number of differently sized support chairs needed and using color coding for quick visual reference.

A method of manufacturing a support chair 20 according to the present invention includes providing a body having an upper surface defining a plurality of cutout pairs. The plurality of cutout pairs is preferably adapted to support rebar 42 or the like. The plurality of cutout pairs 32A, 32B, 32C, 32D preferably results in the support chair being configured to support rebar 42 at any one of three different heights as measured from the base 28 of the support chair 20. The body is preferably configured to allow the support chair 20 to be nested with an additional support chair 20.

The method of the present invention may also include the step of nesting a plurality of the support chairs 20 one within the other and mailing the plurality of support chairs 20. The method may also include providing the body formed by polymer.

A method of using a support chair 20 according to the present invention includes providing a body having an upper surface defining a plurality of cutout pairs 32A, 32B, 32C, 32D. Each of the plurality of cutout pairs 32A, 32B, 32C, 32D may be adapted to support rebar or other material. The plurality of cutout pairs 32A, 32B, 32C, 32D preferably results in the support chair being configured to support rebar 42 or other material at any one of at least three different heights. The method of the present invention may include providing a second body and positioning rebar 42 on the body and the second body so that concrete 52 can be poured thereover while the two support chairs 20 brace the rebar 42 in position.

It is recognized by those skilled in the art, that changes may be made to the above described embodiment of the invention without departing from the broad inventive concept thereof. It is understood, therefore, that this invention is not limited to the particular embodiment disclosed, but is intended to cover to all modifications which are within the spirit and scope of the invention as defined by the appended claims and the drawings.

What is claimed is:

1. A support chair for bracing an object to be embedded in poured material, comprising:

a body having an upper surface defining a plurality of cutouts therealong which form a plurality of cutout pairs, the upper surface being entirely formed by the plurality of cutouts which are positioned adjacently to each other such that adjacent cutouts intersect at a vertex, each cutout pair is formed by two cutouts each having two end points, wherein no two of the plurality of cutouts which do not form the same cutout pair have all endpoints thereof at a common height as measured from a base of the support chair;

each of the plurality of cutout pairs is adapted to support rebar, the plurality of cutout pairs resulting in the support chair being configured to support rebar in at least three different heights as measured from the base of the support chair;

each of the plurality of cutouts share the two end points thereof with adjacent cutouts such that the entire upper surface of the support chair is formed by the plurality of cutouts.

2. The support chair of claim 1, wherein the height difference between the highest and lowest heights of the plurality of cutout pairs is such that the support chair is able to support two pieces of rebar that overlap with each other.

3. The support chair of claim 2, wherein the body further comprises four major lateral surfaces which are angled generally inwardly to allow the support chair to be nested with an additional support chair, wherein a beveled face is located between each of the four major lateral surfaces.

4. The support chair of claim 3, wherein the plurality of cutouts are configured to support rebar in any one of at least four directions without changing the position of the body.

5. The support chair of claim 1, wherein the body further includes the base having a generally annular shape with a generally planar bottom surface.

6. The support chair of claim 1, wherein the body includes a lower portion formed by four legs.

7. The support chair of claim 3, wherein each of the four major lateral surfaces defines a portion of two separate legs to define an opening therebetween having an arched perimeter along an upper portion thereof.

8. The support chair of claim 7, wherein the body further includes a base having a generally annular shape with a generally planar bottom surface.

9. The support chair of claim 8, wherein a first angle, as measured between the beveled face and an axis oriented perpendicular to the generally planar bottom surface of the base, is between approximately ten degrees and approximately thirty degrees.

10. The support chair of claim 9, wherein the first angle, as measured between the beveled face and an axis oriented perpendicular to the generally planar bottom surface of the base, is between approximately fifteen degrees and approximately twenty five degrees.

11. The support chair of claim 10, wherein the first angle, as measured between the beveled face and an axis oriented perpendicular to the generally planar bottom surface of the base, is between approximately nineteen degrees and approximately twenty three degrees.

12. The support chair of claim 11, wherein the first angle, as measured between the beveled face and an axis oriented perpendicular to the generally planar bottom surface of the base, is approximately twenty one degrees.

13. The support chair of claim 9, wherein two of the beveled faces delineate part of a lowest one of the plurality of cutout pairs, as measured from the base of the body.

14. The support chair of claim 13, wherein another two of the beveled faces delineate part of a highest one of the plurality of cutout pairs, as measured from the base of the body.

15. The support chair of claim 14, wherein the poured material is concrete.

16. A support chair for bracing objects to be embedded in poured material, comprising:

a body having an upper surface defining a plurality of cutouts therealong which form a plurality of cutout pairs, wherein no two adjacent cutouts are configured to hold rebar oriented in the same direction, each cutout pair is formed by two cutouts each having two end points, wherein no two of the plurality of cutouts which do not form the same cutout pair have all endpoints thereof at a common height as measured from a base of the support chair, wherein each of the plurality of cutout pairs is adapted to support rebar, the plurality of cutout pairs resulting in the support chair being configured to support rebar in at least three different heights as measured from the base of the support chair, wherein each of the plurality of cutouts share the two end points thereof with adjacent cutouts such that the entire upper surface of the support chair is formed by the plurality of cutouts.

17. The support chair of claim 16, wherein the body further comprises four major lateral surfaces which are angled generally inwardly to allow the support chair to be nested with an additional support chair, wherein a beveled face is located between each of the four major lateral surfaces.

* * * * *